US006793224B2

(12) United States Patent
Stratton

(10) Patent No.: US 6,793,224 B2
(45) Date of Patent: Sep. 21, 2004

(54) TRUCK FOR SKATEBOARDS

(75) Inventor: Neil Stratton, Venice, CA (US)

(73) Assignee: Carver Skateboards, City of Industry, CA (US)

( * ) Notice: Subject to any disclaimer, the term of this patent is extended or adjusted under 35 U.S.C. 154(b) by 0 days.

(21) Appl. No.: 09/801,536

(22) Filed: Mar. 8, 2001

(65) Prior Publication Data

US 2002/0125670 A1 Sep. 12, 2002

(51) Int. Cl.[7] ..... B62M 1/00
(52) U.S. Cl. ..... 280/87.042; 280/87.041
(58) Field of Search ..... 280/11.27, 11.28, 280/87.041, 87.042; D21/765

(56) References Cited

U.S. PATENT DOCUMENTS 565,718 A * 8/1896 Boardman ..... 280/291
3,649,038 A 3/1972 Huckenbeck
4,061,350 A 12/1977 Schmidt, Jr. et al.
4,071,256 A 1/1978 Kimmell
4,168,842 A 9/1979 Kimmell et al.
4,176,850 A * 12/1979 Johnson ..... 280/87.042
4,645,223 A * 2/1987 Grossman ..... 280/87.042
5,372,384 A * 12/1994 Smith ..... 280/842
5,522,620 A 6/1996 Pracas
5,868,408 A * 2/1999 Miller ..... 280/87.042
6,318,739 B1 * 11/2001 Fehn, Jr. ..... 280/87.042

* cited by examiner

*Primary Examiner*—Brian L. Johnson
*Assistant Examiner*—Brian L Swenson
(74) *Attorney, Agent, or Firm*—Tope-McKay & Assoc.

(57) ABSTRACT

A skateboard truck comprising a base attachable to the underside of a skateboard and an arm carried by the base and rotatable relative to the base about a first axis. An axle having a pair of wheels mounted at opposite ends thereof is carried by the arm and the axle is rotatable relative to the arm about a second axis. A spring-loaded linkage is operatively connected between the base and the arm for limiting the rotational motion of the arm and biasing the arm towards a center position aligned with the skateboard's direction of movement. The first and second axes provide pivoting of the skateboard in two dimensions.

14 Claims, 8 Drawing Sheets

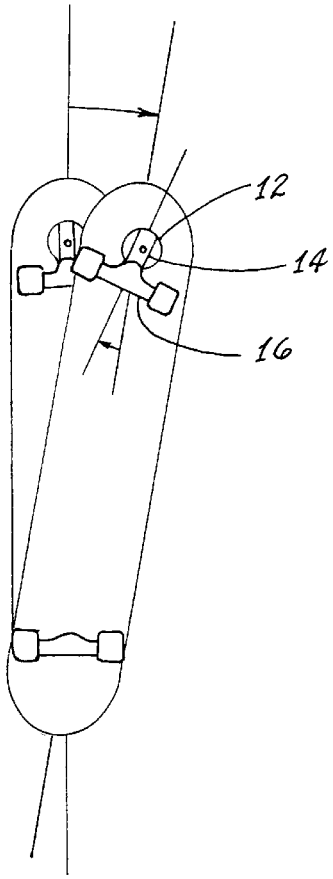
Fig. 6a
Fig. 6b
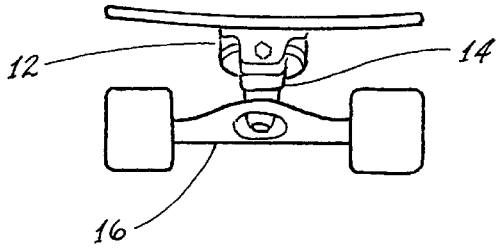
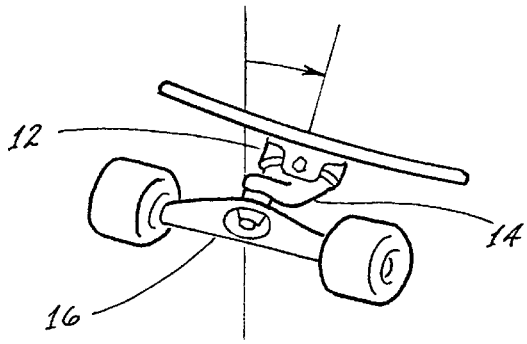
Fig. 6c

TRUCK FOR SKATEBOARDS

FIELD OF THE INVENTION

The present invention is directed to an improved truck for a skateboard, all-terrain board or scooter, and more particularly to a truck having two independently spring-loaded pivoting members.

BACKGROUND OF THE INVENTION

Conventional skateboards utilize steering mechanisms known as trucks. Typically a truck is mounted near each end of the skateboard, and includes a pair of wheels at each end of its axles. The trucks provide some steering response, whereby when a skateboarder shifts weight laterally across the board the axle twists, causing the hoard to turn. The trucks also serve, by means of a suspension system, commonly urethane bushings, to resiliently resist the skater's lateral tilt of the duck, thus stabilizing the board, and returning it to its normal position when the turn is completed. This lateral stability is crucial for both distance riding and aerial tricks where a firm platform is desired. Current tucks must sacrifice their ability to turn for lateral stability, thus becoming stiff and unresponsive when tightened sufficiently. Conversely, loosening the trucks so the board can turn easily makes it dangerously wobbly, especially at higher speeds. Furthermore, even in optimal conditions, the rate of turn provided by conventional trucks is very little.

Previous attempts have been made to design as truck with increased maneuverability. One method utilizes a truck having a trailing castor that provides the skateboard with a second axis of rotation is described in U.S. Pat. No. 5,522,620 to Pracas.

In this prior art device, the truck comprises a conventional truck mounted to a pivotal member. The pivotal member is coupled to the nose of the deck about a hearing member which rotates along a plane parallel to the direction of motion. A pair of stop members are shown that limit the pivotal movement between two extreme positions. Further, a locking member maybe engaged to stop any rotation, thus returning the truck to a conventional configuration.

Although the '620 device provides a second pivot, the lateral plane of pivotal rotation merely provides the front of the skateboard with a side to side movement. Because the axis of rotation is parallel to the direction of motion, lateral weight slit fling does riot bear any leverage upon he pivotal member when the arm is near the center of its range. Further when the pivotal member rotates towards its extreme positions, the skaters' lateral weight imposes exponentially more leverage upon the member causing overturning and loss of control. Additionally, the '620 device tines not regulate the torsional movement of the trailing castor. A strong bias to center is desired when performing aerial tricks so as to provide a predictable and stable landing. Further, regulating the rotational movement by a spring system is also important to stabilize the truck at high speeds.

Accordingly, a need exists for an improved truck that provides the user with more control over the torsional movement of the pivoting member and being adjustable for users of varying needs.

SUMMARY OF THE INVENTION

The present invention provides an improved skateboard truck which pivots about two axes and provides a combination of adjustable lateral stability and enhanced turning abilities. Generally speaking, a tuck according to this invention comprises an axle having a pair of wheels mounted al opposite ends thereof. A shall extends through the center of the axle and is secured thereto on the side of the axle distal from the point of securing the truck to a skateboard. The truck further includes a resilient bushing circumferentially mounted on the shall on the side of the axle proximal to the point of securing the truck to the skateboard for providing a first pivot axis about the axle, and a swivel connected to the axle and adapted to be pivotally attached to the underside of the skateboard about a second pivot axis. The swivel and the bushing are ganged together to provide pivoting of a skateboard in two dimensions.

In a presently preferred embodiment of the invention the skateboard truck includes a base attachable to the underside of a skateboard and an arm carried by the base and rotatable relative to the base about a first axis. An axle having a pair of wheels mounted at opposite ends thereof is carried by the arm and the axle is rotatable relative to the arm about a second axis. A spring-loaded linkage is operatively connected between the base and the arm for limiting the rotational motion of the arm and biasing the arm towards a rest position aligned with the skateboard's direction of movement.

The improved skateboard truck is preferably attached to the front of the skateboard, while a conventional truck is fastened to the rear. Because of the improved capabilities of the present invention the skateboarder is able to propel the skateboard by shifting the nose of the skateboard from side-to-side, lumber, the present invention enables the rider to smoothly navigate the front of the skateboard to-and-fro and complete sharp turns at a rider controlled rate. As such, the skateboard closely simulates the dynamics of a surfboard oil the water.

DESCRIPTION OF THE DRAWINGS

These and other features and advantages of the present invention will be better understood by reference to the following detailed description when considered in conjunction with the accompanying drawings wherein:

FIG. 6A is a top view of the truck in FIG. 1 mounted onto a skateboard, the view showing the arcing, lateral movement of the nose of the skateboard as it moves to-and fro;

FIGS. 6B and 6C are perspective views of the of the truck in FIG. 1 mounted onto a skateboard, the vices showing the arcing; lateral movement of the nose of the skateboard as it moves to-and-fro;

DETAILED DESCRIPTION OF THE INVENTION

Figure 1:
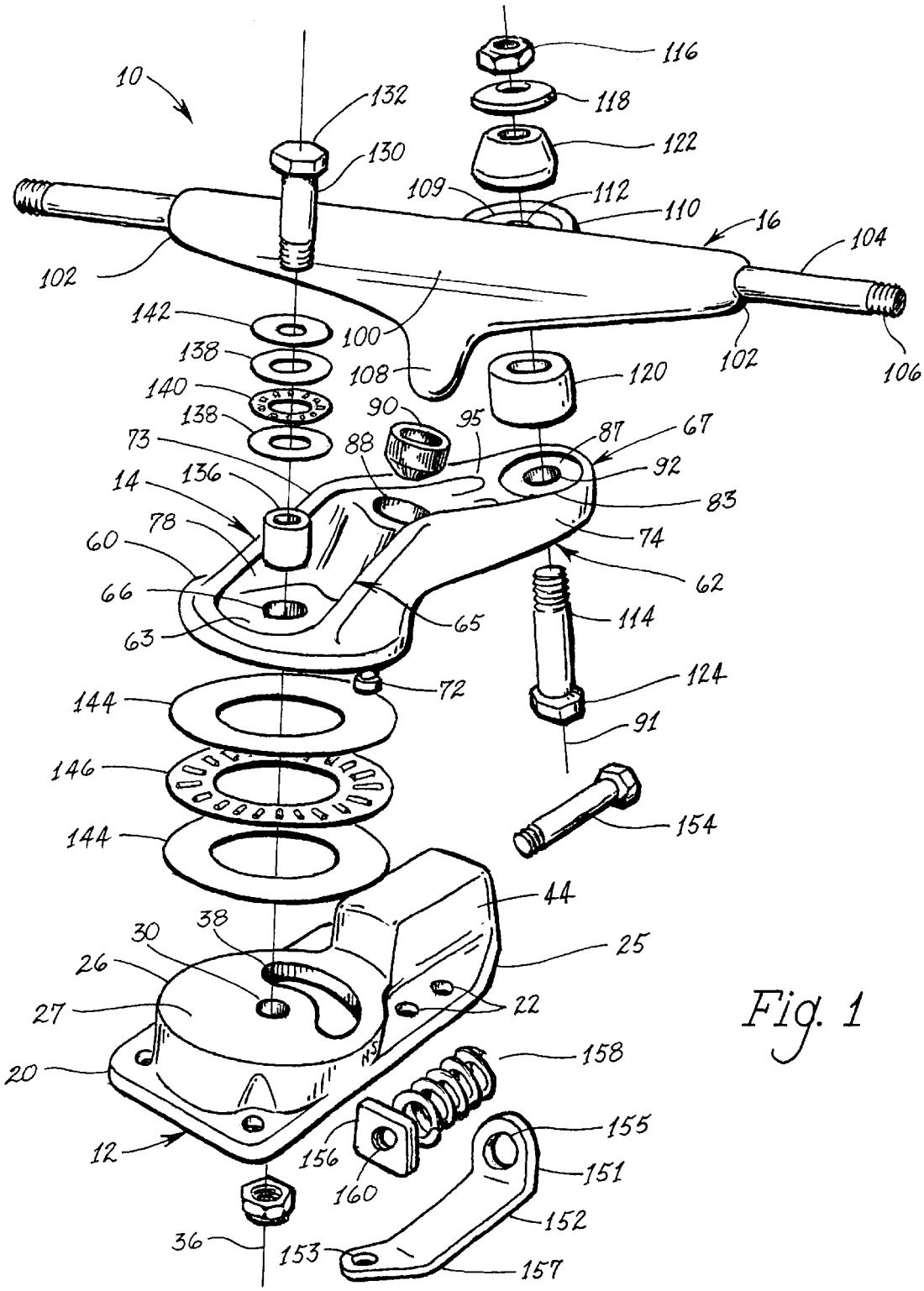
FIG. 1 is an exploded perspective view of the skateboard truck of the present invention.

In a preferred embodiment of the invention, there is provided a skateboard truck 10 having, two independently spring-loaded pivoting; members. As shown in FIG. 1, the truck 10 comprises a baseplate 12, a pivoting member 14, and a hanger 16.

Referring to FIG. 1, the baseplate 12 comprises a casting forming a base 20, a bearing platform 26, and a housing 44. The baseplate can be of any suitable 12 construction and made of any suitable material in a preferred embodiment, the baseplate 12 is cast in A356 prime aircraft grade aluminum trod heat treated to Rockwell T-6. In alternative embodiments the baseplate 12 may be cast or forged of any formable high strength metal or plastic. The base 20 is a substantially rectangular plate having a finite thickness, for example about 3⁄16 inches, a rear tapered portion 25, and plurality of apertures 22. The apertures 22 are suitably configured for mounting the baseplate 12 onto the underside of the skateboard platform.

Figure 2:
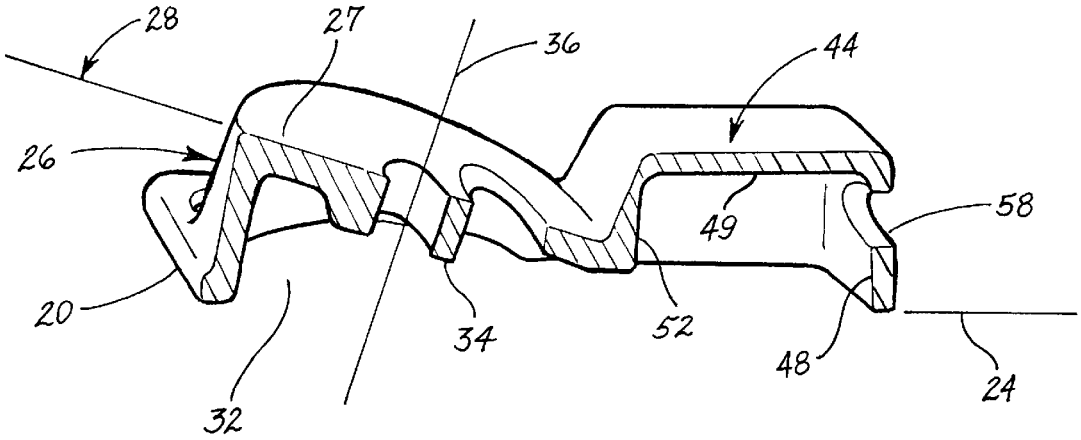
FIG. 2 is a cross-sectional side view of the base plate of the truck in FIG. 1.
Figure 3:
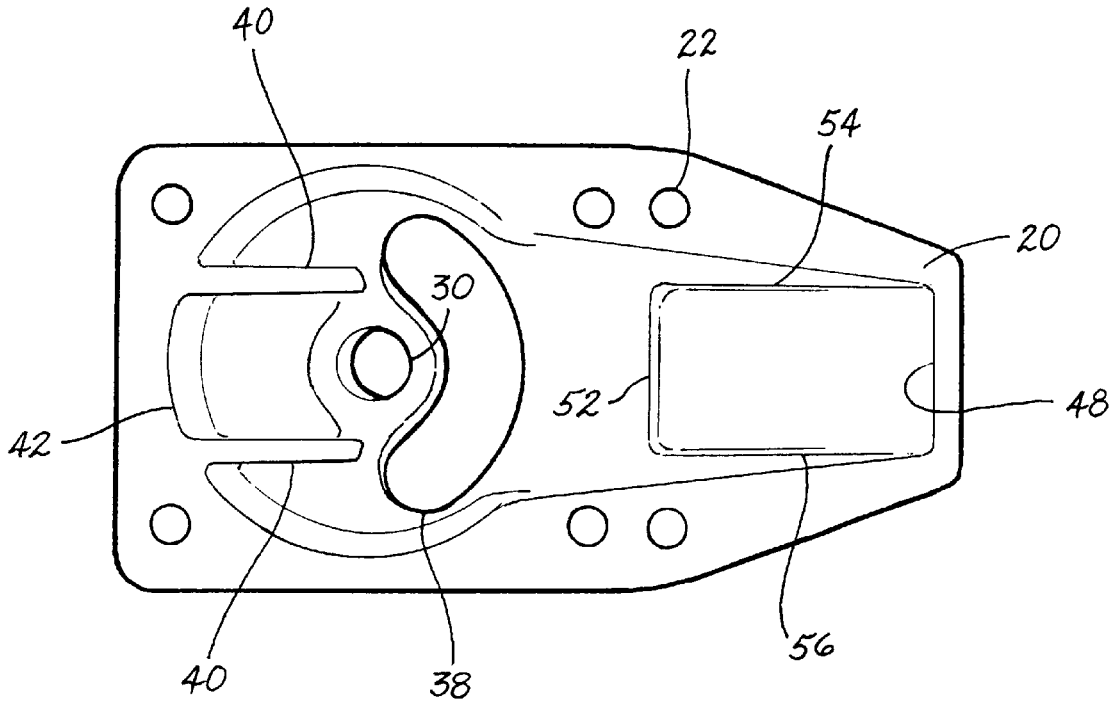
FIG. 3 is a bottom view of the base plate in FIG. 2.

Referring to FIGS. 2 and 3, the bearing platform 26 projects upward, and substantially oblique, from the one end of the base 20. The platform 26 comprises a circular body having at recess 32 formed on its underside by a circular periphery 42 having an inner surface 34. The recess 32 includes a pair of parallel and spaced apart ribs 40 which extend into the recess 32. As shown in FIG. 2, the bearing platform 26 is defined by an upper surface 27, which runs parallel to a bearing plane 28. The bearing plane 28 is defined at an angle oblique to a lateral plane 24 of base 20, preferably at about 10° to about 25°, more preferably at about 17°. The upper surface 27 comprises a central bore 30, defining a first axis 36, substantially perpendicular to the bearing plane 28, and a semicircular notch 38.

The housing 44 projects upward, and substantially perpendicular from the base 20, and is integral with the bearing platform 26. The housing 44 includes a plurality of sidewalls 48, 52, 54, and 56, and atop wall 49, forming a cavity 46 in the housing; 44 for retaining a spring system, as discussed in detail below. Sidewall 48 comprises a circular opening 58 for receiving a bolt.

Figure 4:
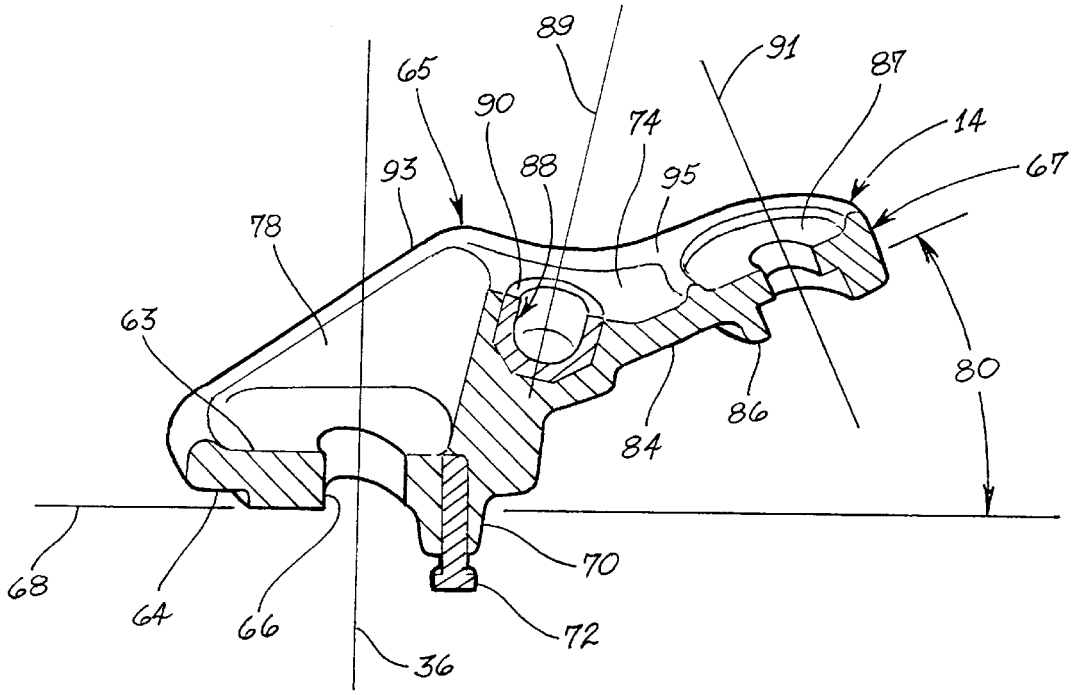
FIG. 4 is a cross-sectional side view of the pivoting member of the truck in FIG. 1.

Referring to FIG. 1, the pivoting member 14 comprises a casting forming a cylindrical pedestal 60 having a unite thickness, and an elongated arm 62. The pivoting member 14 can be of any suitable construction and made of any suitable material. To a preferred embodiment, the pivoting member 14 is cast in A356 prime aircraft grade aluminum and heat treated to Rockwell T-6. In alternative embodiments the pivoting member 14 may be cast or forged of any formable high strength metal or plastic. Referring now to FIG. 4, the pedestal 60 includes a circular notch 64 formed about its base portion, and an orifice, 66. A boss portion 70 supporting a link pin 72 extends downwardly from a base portion of the pedestal 60. Referring; back to FIG. 1, the arm 62 extends upwardly from the base 60 and comprises at pair of gussets 73 and a cantilevered body 74 having at proximal end 65 and distal end 67. The gussets 73 are triangular in shape and disposed in parallel along the proximal end 65 of the body 74. The gussets 73 are integrally formed with the pedestal 60, forming a void 78 which defines a top surface 63 of the pedestal 60.

The body 74 is an arching structure extending from the gussets 73 at an acute angle 80 (see FIG. 4) relative a lateral pedestal base plane 68, preferably at about a 17° angle. A lip 83 is formed along the top surface of the body 74, forming a bearing surface 87. A channel is formed adjacent to bearing surface 87, into which a plurality of stiffening ribs 95 extend. Referring to FIG. 4, a groove 84 formed in the underside of the body 74 comprises a second series of stiffening ribs 86, which extend into the groove 84. The body 74 additionally includes a counterbore 92 defining a second axis 91 inclined at all angle preferably about 30° relative to the pedestal base plane 68. Referring now to FIG. 1, the body 74 further includes a blind hole 88 lined with a urethane cup 90. Referring back to FIG. 4, the blind hole 88 defines a third axis 89 inclined at am angle preferably about 40° relative to the second axis 91.

With reference to FIG. 1, the hanger 16 comprises a casting forming a body portion 100 and end portions 102 extending outwardly from the body portion 100 in opposite directions. The hanger 16 can be of any suitable construction and made of any suitable material. In a preferred embodiment, the hanger 16 is cast in A356 prime aircraft grade aluminum and heat treated to Rockwell T-6. In alternative embodiments, the hanger 16 maybe cast or forged of any formable high strength metal or plastic. The end portions 102 include n pair of concave channels on their undersides. Axle rod 104 extending from end portions 102 carry the skateboard wheels mounted on threaded ends 106. The hanger 16 further includes a pivot pin 108 extending downwardly from a central region of the body portion 100. A platform 110 having a cut-out 109 and an eyelet 112, extends laterally from a central region of the body portion 100, opposite the pivot pin 108. As would be recognized by one skilled in the art, the construction of the hanger body can be modified as desired.

Figure 5:
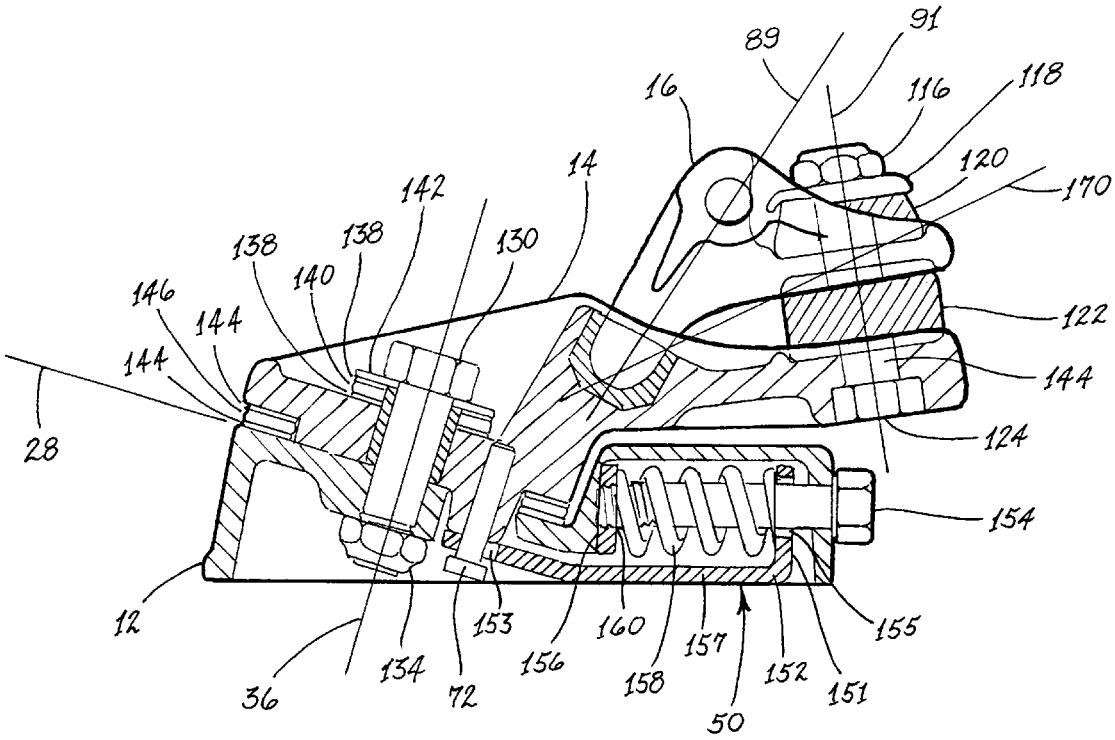
FIG. 5 is a cross-sectional side view of the assembled tuck in FIG. 1.

Referring to FIGS. 1 and 5, the hanger 16 is preferably mounted onto the arm 62 by a kingpin or support member 114 which passes through the eyelet 112 of the platform 110. When assembled, the king pin 114 extends through a first bushing 120 disposed between the platform 110 and the an body 74. The king pin 114 further extends through a second bushing 122 and a flat washer 118 seated within the cut-out 109, disposed between a fastening nut 116 and a top surface of the platform 110. The king pin 114, nut 116, and washer 118 can be of any suitable type or construction and made of any suitable material. In a preferred embodiment, the king pin 114, washer 118 and nut 116 are fabricated from steel having conventional dimensions, preferably about 3⁄8 inches in diameter. Referring to FIGS. 1 and 4, in a presently preferred embodiment the first and second bushings 120 and 122 are urethane. The bolt head 124 of the king pin 114 is displaced on the underside 84 of the body 74, between the plurality of ribs 86, such that the kingpin 114 does not rotate as the nut 116 engages a threaded portion of flicking pin 114. The pivot pin 108 engages the pivot cup 90 within the aperture 88 to align the hanger 16 relative to the arm 62.

The compliant properties of the bushings 120 and 122 allows the hanger 16 to pivot about a longitudinal axis 170 (see FIG. 5) in conventional fashion, when a sufficient load is applied to an end portion 102 of the hanger 16. As such, the hanger 16 functions as a first resilient, or sprint,—loaded pivoting member. As will he recognized by one skilled in the art, the mounting of the hanger 16 to the arm 62 can be modified as desired. For example, a system using a pair of compression springs, as described in U.S. Pat. No. 5,263, 725 to Gesmer et al., maybe used instead of the urethane bushing system.

The pivoting member 14 is preferably mounted onto the baseplate 12 is by a pivot bolt 130 which passes through the pedestal orifice 66 of the pivoting member 14. When assembled, the pivot bolt 130 extends through a nut 134, a bronze bushing 136, a pair of bearing plates 138, a first bearing 140, and a flat washer 142. The pivot bolt 130, nut 134, and washer 142 can be of any suitable type or construction and made of any suitable material. In a preferred embodiment, the pivot bolt 130, nut 134, and washer 142 are fabricated from steel having conventional dimensions, preferably about ⅜ inches in diameter.

The pivoting member 14 is assembled onto the baseplate 12 such that the boss 70 engages the semicircular notch 38. The washer 142 and the first bearing 140, which is sandwiched between a pair of hearing plates 138, are displaced between the pivot bolt head 132 and the pedestal top surface 63. The first bearing 140 can be of any suitable type or construction and made of any suitable material. In a preferred embodiment, the first bearing 140 is a steel needle thrust hearing having an outer diameter of about ⅞ inches and an inner diameter of about ½ inches. The bronze bushing 136 comprises an inner aperture suitable for receiving the pivot bolt 130 and is disposed within the aperture 66 to provide minimum friction between the pivoting member 14 and the pivot bolt 130. A bearing assembly comprising a second bearing 146 sandwiched between a pair of bearing washers 144, is disposed with the circular notch 64 in between the pedestal 60 and the an upper surface 27. The nut 134 is disposed within the housing recess 32, between the pair of ribs 40, such that the nut 134 is confined and can not rotate as the nut 134 engages a threaded end portion of the pivot bolt 130.

The second bearing 146 can be of any suitable type or construction and made of any suitable material. In a preferred embodiment, the second bearing 146 is a steel needle thrust bearing having an outer diameter of about 2 3/16 inches and an inner diameter of about 1½ inches. The bearings 140 and 146 function to provide smooth rotation of the pivoting member 14. In alternative embodiments, other means may be used to provide minimal friction between the arm 62 and the base 12, such as ball hearings, oil impregnated bronze plain bearings, flexures (flexible structures), or the like.

A spring system 50 retained within the housing 44 includes a link 152, a link bolt 154, a spring 158, and a not plate 156. The link 152 comprises a resilient metal formed in an L-shape, having a first portion 151 extending substantially perpendicular from a second portion 157 that is substantially canted at its distal end. The link 152 is preferably formed from a sheer of stainless steel, but may be of airy suitable material having similar material properties. The first portion 151 comprises a bolt opening 155 centrally displaced along the first portion 151. The second portion 157 comprises a link pin opening 153 along its canted distal end.

The spring system 50 is coupled to the housing 44 bypassing the link bolt 154 through the circular and bolt openings 58 and 155. In a preferred embodiment, the link bolt 154 is Grade 8 steel having a diameter of about ⅝ inches. A threaded portion of the link bolt 154 engages a threaded hole 160 centrally located within the nut plate 156. The spring 158 is preferably a steel heavy-duty compression spring disposed between the nut plate 156 and the first portion 151 of the link 152.

The spring system 50 is coupled to the pivoting member 14 by engaging the link pin 72 with the link opening 153 on the canted end of the link 152. The spring system 50 functions to control the rotational movement of the pivoting member 14. The link 152 is spring-loaded to resist and control rotational movement of the pivoting member 14. By turning the link bolt 154 clockwise, tile threaded portion of the bolt 154 engages the out plate 156 and compresses the spring 158. The spring 158 then applies a spring load to the first portion 151 of the link 152, and further, stiffens the resilient movement or tension in the link 152. Thus, if the threaded portion the link bolt 154 is fully engaged with the nut plate 156, the tension in the link 152 will stiffen and the spring system 50 will constrain the pivoting member 14 from rotational translation, thereby increasing the turning resistance likewise, as the threaded portion the link bolt 154 is disengaged from the nut plate 156, the pivoting member 14 is increasingly free to rotate about the perimeter defined by the semicircular slot 38, as the spring system 50 would exert minimal spring load on the link pin 72, thereby loosening the turning resistance.

The frictionless properties of the bearings 140 and 146 allow the pivoting member 14 to pivot about the first axis 36 in a plane oblique to the direction of movement when a sufficient side load is applied on the arm 62. The spring system 50 applies a spring-load on the, pivoting member 14, limiting the rotational translation of the pivoting member 14.

In accordance with the preferred embodiments above, the hanger 16 functions as a first resilient or spring-loaded pivoting member. Similarly, the pivoting member 14 functions as a second resilient or spring-loaded pivoting member. As would be recognized by one skilled in the art, the mounting of the pivoting member 14 to the baseplate 12 and coupling the pivoting member 14 to the spring system 50 can be modified as desired. For example, a urethane bushing, leaf spring or extension spring system wilt non-indexed centering properties may be used in place of the compression spring system.

In operation, the present invention is ideal for turning; a skateboard at a parabolic rate. To perform this function, the improved truck 10 is provided at the front of the skateboard while a conventional truck is provided at the rear. An example of such a conventional truck is provided in U.S. Pat. No. 3,945,655, the disclosure of which is incorporated herein by reference. The skateboard is navigated by a rider standing on its deck, by shifting his/her weight from side to side such that it moves in a forward direction. The rider can propel the skateboard forward without removing his/her feel from the deck. FIGS. 7C and 7D show the serpentine motion of the path of the front truck, which is depicted as 165, as it weaves over the path of a conventional rear truck, depicted as 161. It is this difference in frequency between the two sinusoidal paths that is the basis for forward propulsion of the skateboard. In accordance with the present invention, the rear truck becomes a relative point from which the front truck may pivot, and such dynamics acts to poll the board forward, as will be described in further detail later.

The improved maneuvering capabilities of a skateboard incorporating the truck 10 is accomplished by the dual pivoting characteristics of the truck 10. The resilient bushings 122 and 120 facilitate a first pivoting axis 170 inclined at approximately 30° to 60° relative to the plane of movement. The pivoting member 14 provides a second pivoting axis substantially oblique to the place of movement, and wherein the. Second pivoting axis is inclined relative the first pivot axis at an angle preferably at about 130° to about 160°, more preferably at 140°. The dual pivoting truck 10 enables the nose of the skateboard to move in a side-to-side motion.

Figure 7A:
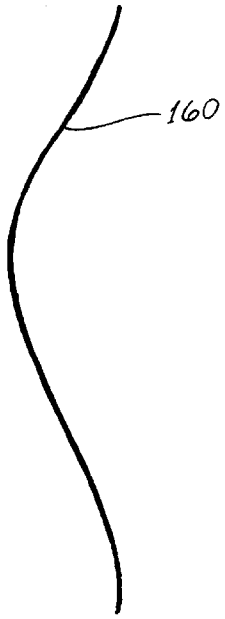
FIGS. 7A and 7B are simplified schematic views of the path of motion of a conventional skateboard.
Figure 7B:
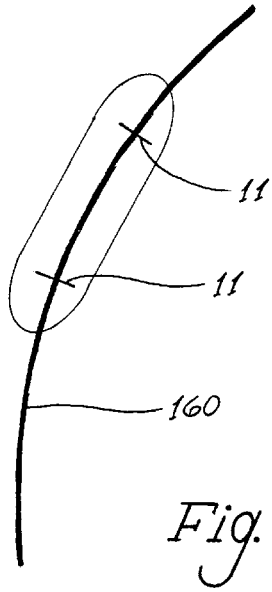
Figure 7C:
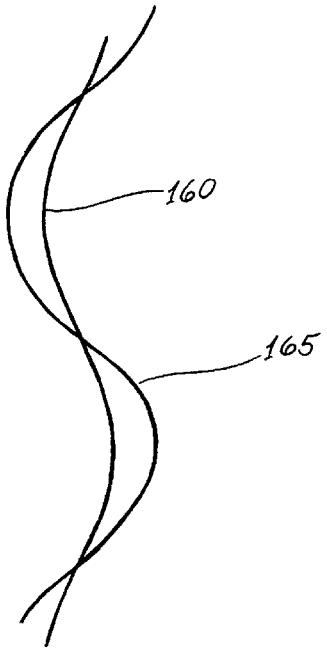
FIGS. 7C and 7D are simplified schematic views of the path of motion of the skateboard in FIG. 6.
Figure 7D:
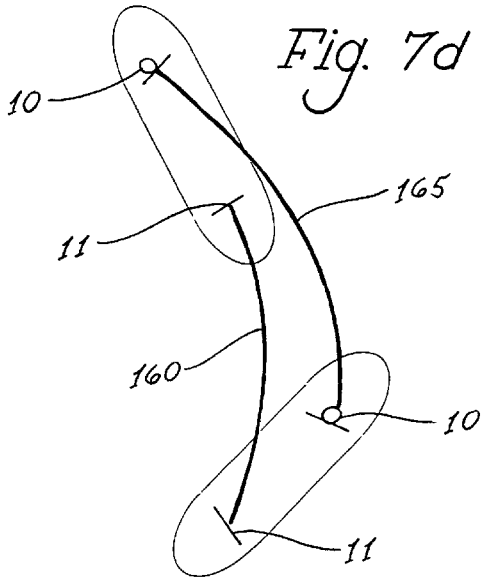

Referring to FIG. 7A, skateboards using a pair of "conventional" trucks 11 turn together at a constant rate along primary sinusoidal path 161. Both front and rear trucks pivot in one dimension symmetrically and in fixed relation, as shown in FIG. 7B. A skateboard according to the preferred embodiments of the present invention, utilizes an improved front truck 10 in combination with a "conventional" rear truck 11. According to this embodiment, as shown in FIGS. 7C and 7D, the rear "conventional" truck 11 turns on the primary path 161, while simultaneously, the front tuck 10 turns on a secondary sinusoidal path 165. As such, the skateboard may trace a variable parabolic path. The front and rear trucks of the skateboard pivot asymmetrically, as the rear truck pivots in one dimension and the front truck pivots in two dimensions, in contrast to the fixed relation provided by a skateboard utilizing a pair of conventional trucks. The asymmetric properties of the improved skateboard enables the front and rear trucks to turn independently, allowing a skateboard rider to create a variable arc of turn with all wheels in contact with the ground, while propelling the skateboard forward.

The angled configuration of the bearing plane 29 (see FIG. 5) defines the plane of movement of the nose of the skateboard to-and-fro as an arc illustrated in FIGS. 6A–C. The arcing lateral movement of the nose provides secondary torquing on the pivoting member 14, in addition to the torque created by weight shift, allowing the rider to turn the skateboard with minimal effort. Additionally, the arcing lateral movement of the nose enables the rider to "carve" the skateboard in a forward serpentine motion as the users twists or shifts his/her weight back acid forth, increasing the angle of the plane 28 increases the amount of secondary torque that the rider can apply to the pivoting member 14 by shifting his/her weight from one side to the other. As such, the truck of present invention is improved over trucks of the prior art, as it balances the combination of torque upon the arm 62 created by the lateral weight shifting of the user during the side-to-side movement of the skateboard, so that the two movements call work smoothly together. Without the angled bearing plane, lateral weight shift from the center position would bear too little, torque upon the rotation of the arm 62. Conversely. lateral weight shift created upon the arm 62 in a turning position bears too much torque. This imbalance causes jerkiness and loss of turning; control.

In use, the truck 10 is attached to the skateboard platform such that the arm 62 of the pivoting member 14 extends rearward This configuration causes the truck 10 to restore the truck wheels to their center position as the skateboard propels forward. Analogous to a shopping cart, where the wheels are behind the pivot point, the forward movement of the skateboard tends to align the pivoting member 14 with the direction of movement. Thus, the pivoting member 14 acts to automatically center, or self correct itself, providing stability to the tuck 10 as the skateboard travels at higher speeds.

Referring to FIG. 5, the spring system 50 functions to provide the truck 10 with additional self-centering capabilities. The spring-loaded link 152 constantly acts upon the link pin 72 to return the truck 10 to its center position. As such, the, spring system 50 creates a "non-indexing" center. In other words the user can push the front of the board from one side to another smoothly past the truck's center position, mimicking the non-biased dynamics of a surfboard. Additionally, the spring system 50 creates a resistance against the arm 62 that correlates to the resistance against the hanger provided by the urethane bushings 120 and 122.

Furthermore, a rider performing an aerial trick, such as all Ollie, can return the board back to the ground confidently, as the spring system 50 returns the truck 10 firmly back to a conventional orientation upon landing of the board. Thus, the present invention further overcomes the inherent problems of pivoting tricks of the prior art.

A user may adjust the amount of "freedom" of pivotal resistance of the truck 11 via the link bolt 154. By tightening or loosening the link bolt 154, the user can vary the tension of the spring 158 on the link 152, which in turn, limits the rotational movement of the pivoting member 14. Thus, a beginner can fully engage the link bolt 154, such that the skateboard becomes very stable. A more advanced rider, can loosen the link bolt 154 to provide more pivotal freedom and increased maneuvering. For example, the present invention enables an advanced rider to complete a sharp U-turn on a sidewalk of conventional dimensions.

Figure 8:
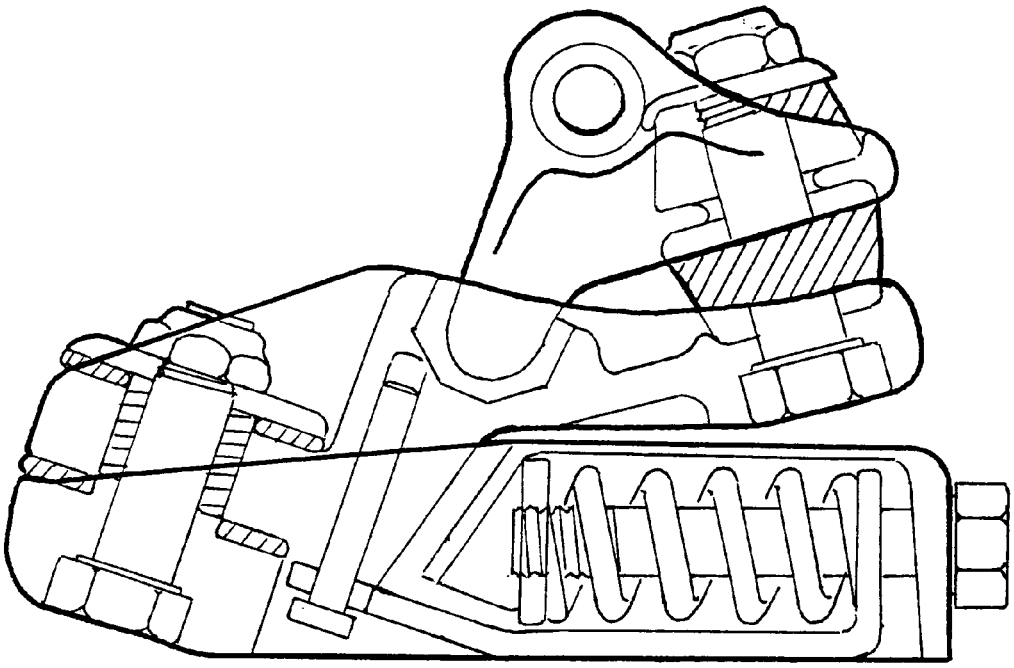
FIG. 8 is a side view of an alternative embodiment of the truck in FIG. 1.

In alternative embodiments, the base plate of the truck can be altered to any suitable size or shape. An example of a modified embodiment is shown in FIG. 8. In other embodiments, the pivoting member 14 and hanger 16 may be integrated into a single piece. In this embodiment, the integrated pivoting member 14 may include an axle resiliently mounted about all extended portion of the pivoting member 14 such that the axle may pivot relative to the pivoting member 14.

The preceding description has been presented with reference to presently preferred embodiments of the invention. Workers skilled in the art and technology to which this invention pertains will appreciate that alterations and changes in the described structure may be practiced without meaningfully departing from the principal, spirit and scope of this invention.

Accordingly, the foregoing description should not be read as pertaining only to the precise structures described and illustrated in the accompanying drawings, but rather should be read consistent with and as support to the following claims which are to have their fullest and fair scope.

What is claimed is:

1. A skateboard truck comprising:

an arm adapted to be pivotally attached to an inclined surface, inclined relative to the underside of a skateboard deck having a first skateboard truck pivot axis;

an axle, the axle being coupled with the arm by a support member secured with the midpoint of the axle; and a resilient bushing circumferentially disposed about the support member for providing a second skateboard truck pivot axis relative to the axle the arm and bushing being ganged together to provide independently adjustable pivoting of the skateboard truck about two axes of freedom.

2. The skateboard truck of claim 1, wherein the arm is attached with the underside of the skateboard about a base having an inclined bearing surface of the first pivot axis relative to the skateboard deck.

3. The skateboard truck of claim 2, wherein the bearing surface is inclined at an angle ranging from about 10° to about 25° relative to the skateboard deck.

4. The skateboard truck of claim 3, wherein the second pivot axis is inclined at an angle approximately 30° to approximately 60° relative to the skateboard deck.

5. The skateboard truck of claim 4, wherein the first pivot axis is inclined relative to the second pivot axis at an angle ranging from about 130° to about 160°.

6. The skateboard truck of claim 2, further comprising a springloaded linkage having adjustable tension operatively connected between the base and the arm for limiting rotational movement of the arm relative to the base and biasing the arm towards a position aligned with the longitudinal axis of the skateboard.

7. The skateboard truck of claim 6, wherein the tension in the linkage is adjusted by engaging a threaded portion of a bolt that extends through a portion of the linkage and a compression spring disposed between a portion of the linkage and to plate, with a threaded aperture on the plate for compressing the spring between the linkage and the plate to spring-load the linkage as the bolt further engages the aperture.

8. A skateboard truck comprising:

a base attachable to the underside of a skateboard deck;

an arm carried by the base wherein the arm is pivotally attached in an inclined manner relative to the base about a first axis;

an axle, the axle being carried by the arm and pivotally attached in an inclined manner relative to the arm about a second axis; and a coupling operatively connected between the base and the arm, whereby the first and second axes provide independently adjustable pivoting of the skateboard truck in two dimensions.

9. The skateboard truck of claim 8, wherein the base comprises an inclined bearing surface of the first pivot axis relative to the skateboard deck.

10. The skateboard truck of claim 9, wherein the hearing surface is inclined at an angle ranging from about 10° to about 25° relative to the skateboard deck.

11. The skateboard truck of claim 10, wherein the first axis is inclined at an angle approximately 30° to approximately 60° relative to the skateboard's plane.

12. The skateboard truck of claim 11, wherein the second axis is inclined relative the first pivot axis at an angle ranging, from about 130° to about 160°.

13. The skateboard truck of claim 8, wherein the coupling is a spring-loaded linkage having adjustable tension for limiting rotational movement of the arm relative the base, and biasing the arm towards a position aligned with the longitudinal axis of the skateboard.

14. The skateboard truck of claim 13, wherein the tension in the linkage is adjusted by engaging a threaded portion of a bolt that extends through a portion of the linkage and a compression spring disposed between a potion of the linkage and a plate, with a threaded aperture on the plate for compressing the spring between the link age and the plate to spring-load the linkage as the bolt further engages the aperture.

* * * * *